US011104501B1

(12) United States Patent
Voorhees

(10) Patent No.: US 11,104,501 B1
(45) Date of Patent: Aug. 31, 2021

(54) VOID FILLING STRUCTURAL PACKAGING ELEMENT

(71) Applicant: Rational Packaging LLC, Springfield, TN (US)

(72) Inventor: Samuel C. Voorhees, Louisville, KY (US)

(73) Assignee: Rational Packaging LLC, Springfield, TN (US)

( * ) Notice: Subject to any disclaimer, the term of this patent is extended or adjusted under 35 U.S.C. 154(b) by 0 days.

(21) Appl. No.: 16/520,072

(22) Filed: Jul. 23, 2019

Related U.S. Application Data

(63) Continuation-in-part of application No. 16/244,676, filed on Jan. 10, 2019, now Pat. No. 10,899,524, and a continuation of application No. 29/667,167, filed on Oct. 18, 2018, now Pat. No. Des. 908,005, and a continuation-in-part of application No. 29/667,165, filed on Oct. 18, 2018, now Pat. No. Des. 908,004, and a continuation-in-part of application No. 29/667,164, filed on Oct. 18, 2018, now Pat. No. Des. 908,499, and a continuation-in-part of application No. 29/667,161, filed on Oct. 18, 2018, now Pat. No. Des. 908,003, and a continuation-in-part of application No. 15/964,439, filed on Apr. 27, 2018, now Pat. No. 10,822,138.

(51) Int. Cl.
*B65D 81/05* (2006.01)
*B65D 81/127* (2006.01)

(52) U.S. Cl.
CPC ..... *B65D 81/127* (2013.01); *B65D 2581/053* (2013.01)

(58) Field of Classification Search
CPC ..... B65D 81/127; B65D 2581/053; B65D 81/053; B65D 81/05
USPC ..... 206/586, 453, 521
See application file for complete search history.

(56) References Cited

U.S. PATENT DOCUMENTS

| | | | | |
|---|---|---|---|---|
| 3,244,347 | A | 4/1966 | Jenk | |
| 3,982,682 | A * | 9/1976 | Fremion | B65D 5/5033 206/586 |
| 4,125,187 | A * | 11/1978 | Vecchiotti | H01M 2/0237 206/521 |
| 4,771,893 | A | 9/1988 | Liebel | |
| 5,131,541 | A | 7/1992 | Liebel | |
| 5,267,651 | A | 12/1993 | Hughes | |
| 5,593,039 | A | 1/1997 | Ortlieb | |
| 6,059,104 | A | 5/2000 | Widman | |
| 6,186,329 | B1 | 2/2001 | Qiu | |
| 6,234,314 | B1 | 5/2001 | Qiu et al. | |
| 6,247,596 | B1 | 6/2001 | Muyskens | |
| 6,286,683 | B1 | 9/2001 | Hunt et al. | |

(Continued)

*Primary Examiner* — Steven A. Reynolds
(74) *Attorney, Agent, or Firm* — Shaddock Law Group, PC

(57) ABSTRACT

A void filling structural packaging element, including at least some of a sheet formed of an elongate portion of material, wherein the sheet extends, along a longitudinal axis, from a first terminal end to a second terminal end, and wherein the sheet includes one or more alternating ridges and grooves, formed along a length of the sheet, from a proximal end to a distal end; a body portion formed by an end portion of the sheet attached or coupled to a portion of a side wall of the sheet, and wherein a deformable hollow is defined within the body portion; and a packaging element leg portion formed of a portion of the sheet that extends from the body portion.

20 Claims, 13 Drawing Sheets

(56) References Cited

U.S. PATENT DOCUMENTS

| | | | | |
|---|---|---|---|---|
| 6,513,662 | B1 | 2/2003 | Stebelton | |
| 6,520,336 | B2 | 2/2003 | Baechle | |
| 6,595,367 | B2 | 7/2003 | Baechle | |
| 7,014,046 | B2 | 3/2006 | Niu et al. | |
| 7,048,118 | B2 | 5/2006 | Baechle | |
| 7,111,735 | B2 | 9/2006 | Lowry | |
| 7,128,214 | B2 | 10/2006 | Qiu et al. | |
| 7,137,517 | B2 | 11/2006 | Lowry et al. | |
| 7,281,648 | B2 | 10/2007 | Lowry | |
| 7,625,616 | B2 * | 12/2009 | Van de Camp ..... | B65D 81/054 428/34.2 |
| 7,841,469 | B2 | 11/2010 | Muyskens | |
| 8,079,476 | B2 * | 12/2011 | Simms ..... | B65D 81/054 206/453 |
| 8,297,492 | B2 | 10/2012 | Muyskens | |
| 9,428,298 | B2 | 8/2016 | Bersamin et al. | |
| 9,783,333 | B1 * | 10/2017 | De Los Santos ..... | B65D 5/006 |
| 2002/0189969 | A1 * | 12/2002 | Renck ..... | B65D 81/054 206/586 |
| 2003/0052037 | A1 | 3/2003 | Baechle et al. | |
| 2005/0035257 | A1 | 2/2005 | Niu et al. | |
| 2005/0092633 | A1 | 5/2005 | Baechle | |
| 2005/0136204 | A1 | 6/2005 | Qui et al. | |
| 2006/0070911 | A1 | 4/2006 | Lowry | |
| 2006/0108408 | A1 | 5/2006 | Lowry | |
| 2006/0157380 | A1 | 7/2006 | Lowry | |
| 2006/0292368 | A1 | 12/2006 | Van de Camp | |
| 2008/0237419 | A1 | 10/2008 | Baechle et al. | |
| 2010/0000906 | A1 | 1/2010 | Muyskens | |
| 2011/0278310 | A1 | 11/2011 | Muyskens | |
| 2015/0122690 | A1 | 5/2015 | Bersamin et al. | |
| 2018/0086532 | A1 * | 3/2018 | Belanger ..... | B65D 81/053 |

* cited by examiner

VOID FILLING STRUCTURAL PACKAGING ELEMENT

CROSS-REFERENCE TO RELATED APPLICATIONS

This patent application claims the benefit of U.S. patent application Ser. No. 16/244,676, filed Jan. 10, 2019, the benefit of U.S. patent application Ser. No. 29/667,167, filed Oct. 18, 2018, the benefit of U.S. patent application Ser. No. 29/667,165, filed Oct. 18, 2018, the benefit of U.S. patent application Ser. No. 29/667,164, filed Oct. 18, 2018, the benefit of U.S. patent application Ser. No. 29/667,161, filed Oct. 18, 2018, and the benefit of U.S. patent application Ser. No. 15/964,439, filed Apr. 27, 2018, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging elements. More specifically, the present disclosure relates to a void filling structural packaging element.

2. Description of Related Art

It is generally known to use various packaging elements to package products for storage or shipping. Typically, packaging elements are constructed so as to stabilize the contained item or items and provide a certain degree of cushioning against breakage, while being moved or transported.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging elements have various shortcomings. Among other things, known packaging elements do not provide adequate filling of void spaces or cushioning between packaged products and the product packaging. Additionally, typical packaging elements also failed to provide sufficient tabs or legs to appropriately secure or maintain the packaging elements in a desired location relative to a packaged product. Furthermore, known packaging elements or assemblies do not provide a sufficient cushioning to the packaged article or product.

In various exemplary, nonlimiting embodiments, the void filling structural packaging element of the present disclosure provides a multi-layer sheet or portion of material having a substantially sinusoidal or recurve shape along its entire length and including a body portion formed by attaching an end portion of the sheet to a side wall of the sheet. A deformable hollow is formed within the body portion and a packaging element leg portion is formed of the portion of the sheet that extends from the body portion. Thus, in various exemplary, nonlimiting embodiments, the void filling structural packaging element is substantially "P" or "B" shaped, when viewed from a top or bottom.

In certain exemplary, nonlimiting embodiments, the void filling structural packaging element includes a score mark or complete or partial perforation formed along a longitudinal axis of the sheet. The score mark provides a line along which the sheet may be bent. By bending the sheet along the score mark, a portion of the sheet can be more easily wrapped to form the body portion.

In certain exemplary, nonlimiting embodiments, score marks or complete or partial perforations may be formed at spaced apart locations, along a longitudinal axis of the sheet, to provide lines or areas along which the sheet may be bent to more easily form the body portion of the void filling structural packaging element.

In various exemplary, non-limiting embodiments, the void filling structural packaging element of the present disclosure comprises a sheet formed of an elongate portion of material, wherein the sheet extends, along a longitudinal axis, from a first terminal end to a second terminal end, and wherein the sheet includes one or more alternating ridges and grooves, formed along a length of the sheet, from a proximal end to a distal end; a body portion formed by an end portion of the sheet attached or coupled to a portion of a side wall of the sheet, and wherein a deformable hollow is defined within the body portion; and a packaging element leg portion formed of a portion of the sheet that extends from the body portion.

In certain exemplary, nonlimiting embodiments, the sheet extends continuously, from the first terminal end to the second terminal end.

In certain exemplary, nonlimiting embodiments, the sheet comprises a single layer of material.

In certain exemplary, nonlimiting embodiments, the sheet comprises paperboard, chipboard, container board, box board, cardboard, or corrugated fiberboard.

In certain exemplary, nonlimiting embodiments, each of the alternating ridges and grooves extends substantially parallel to the longitudinal axis of the sheet.

In certain exemplary, nonlimiting embodiments, the sheet is curvilinear along the length of the sheet, from the proximal end to the distal end.

In certain exemplary, nonlimiting embodiments, the alternating ridges and grooves form a sinusoidal succession of waves or curves.

In certain exemplary, nonlimiting embodiments, the body portion is formed by a portion of an inner wall of an end portion of the sheet, proximate the proximal end, attached or coupled to a portion of the inner wall of the sheet.

In certain exemplary, nonlimiting embodiments, the body portion is formed by a portion of an outer wall of an end portion of the sheet, proximate the proximal end, attached or coupled to a portion of the inner wall of the sheet.

In certain exemplary, nonlimiting embodiments, the body portion forms a substantially square, rectangular, or free-form shape.

In certain exemplary, nonlimiting embodiments, a score mark or perforation is formed substantially parallel to the longitudinal axis of the sheet.

In various exemplary, non-limiting embodiments, the void filling structural packaging element of the present disclosure comprises a sheet, wherein the sheet extends, along a longitudinal axis, from a first terminal end to a second terminal end, and wherein the sheet is curvilinear along a length of the sheet, from a proximal end to a distal end; a body portion formed by an end portion of the sheet attached or coupled to a portion of a side wall of the sheet, and wherein a deformable hollow is defined within the body portion; and a packaging element leg portion formed of a portion of the sheet that extends from the body portion.

In various exemplary, non-limiting embodiments, the void filling structural packaging element of the present disclosure comprises a sheet, wherein the sheet extends, along a longitudinal axis, from a first terminal end to a second terminal end, wherein the sheet is curvilinear along a length of the sheet, from a proximal end to a distal end, and wherein the sheet includes a body portion and a packaging element leg portion; wherein the body portion is formed by an end portion of the sheet attached or coupled to a portion of a side wall of the sheet, and wherein a deformable hollow is defined within the body portion; and wherein the packaging element leg portion is formed of a portion of the sheet that extends from the body portion.

Accordingly, the present disclosure provides a void filling structural packaging element that can be easily and accurately positioned relative to a packaged article or product, when needed.

The present disclosure separately provides a void filling structural packaging element that provides lower costs for handling and storage.

The present disclosure separately provides a void filling structural packaging element with a high degree of compressional strength.

The present disclosure separately provides a void filling structural packaging element that provides an element for filling of void spaces or cushioning between packaged products and the product packaging.

The present disclosure separately provides a void filling structural packaging element that provides a tab or leg portion to assist in securing and/or maintaining the packaging element in a desired location relative to a packaged product and product packaging.

The present disclosure separately provides a void filling structural packaging element that provides an increased level of cushioning to a packaged article or product within a product package.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
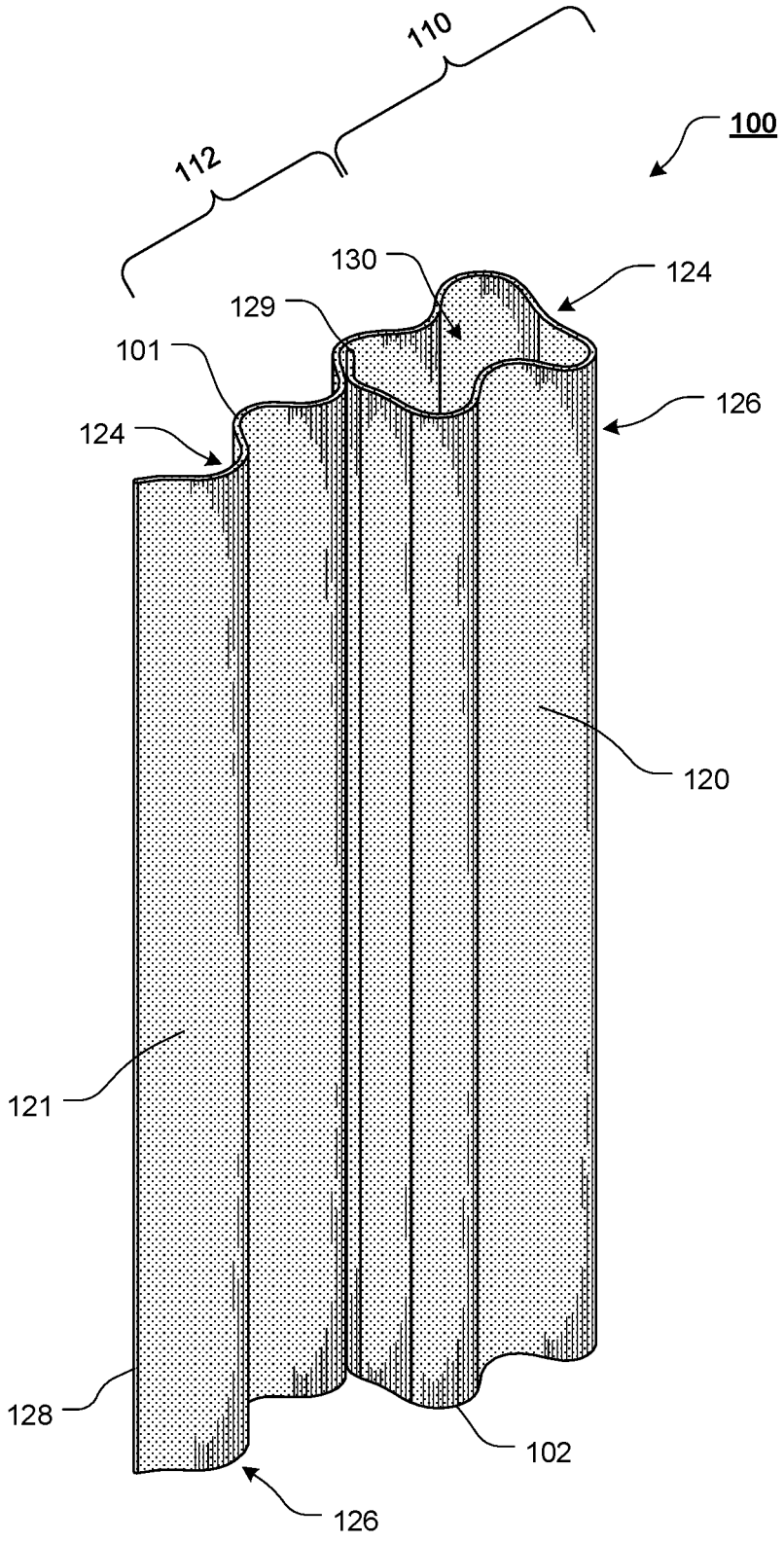
FIG. 1 illustrates an upper perspective view of an exemplary embodiment of a void filling structural packaging element, according to the present disclosure.
Figure 2:
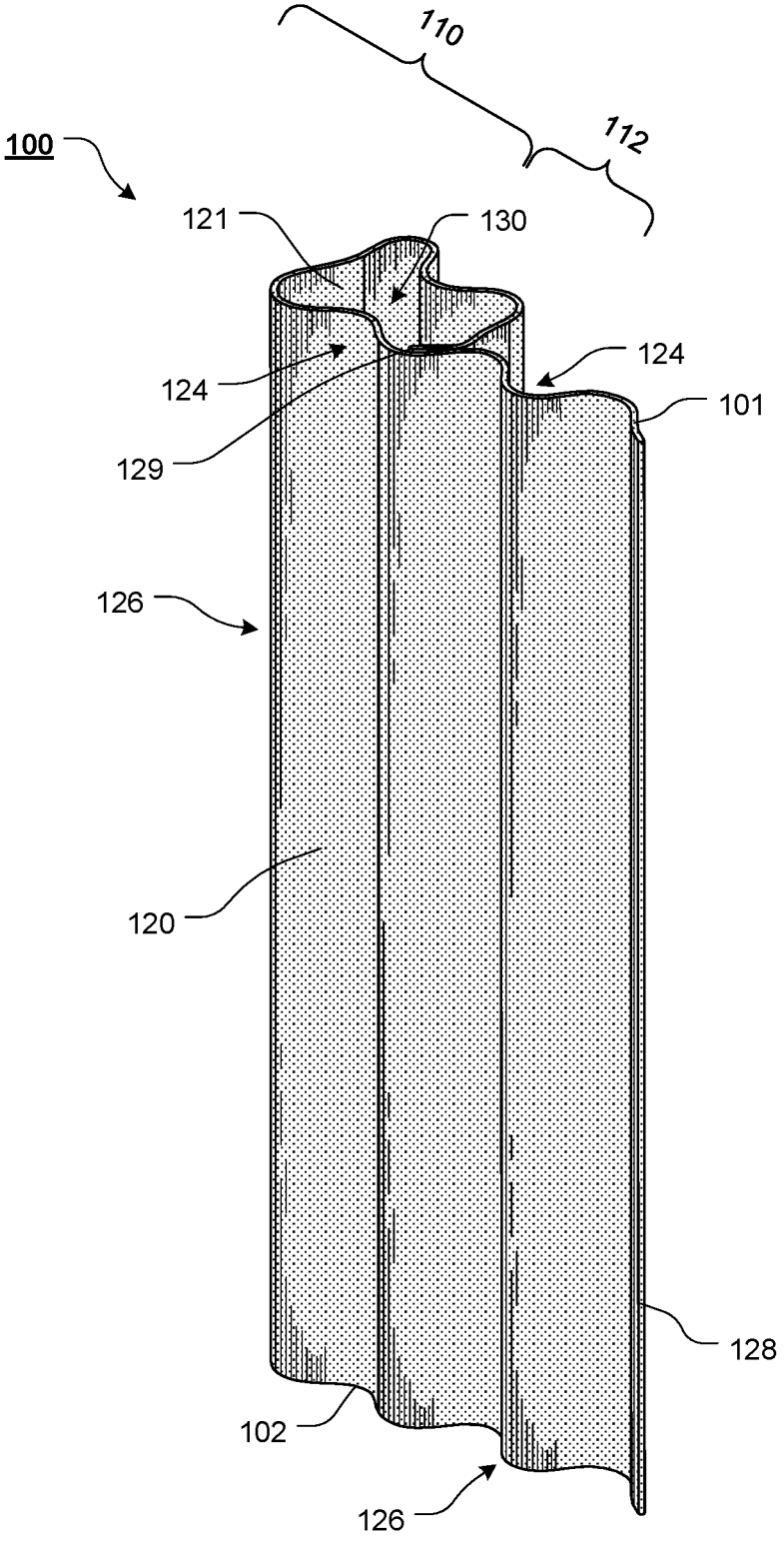
FIG. 2 illustrates an upper perspective view of an exemplary embodiment of a void filling structural packaging element, according to the present disclosure.
Figure 3:
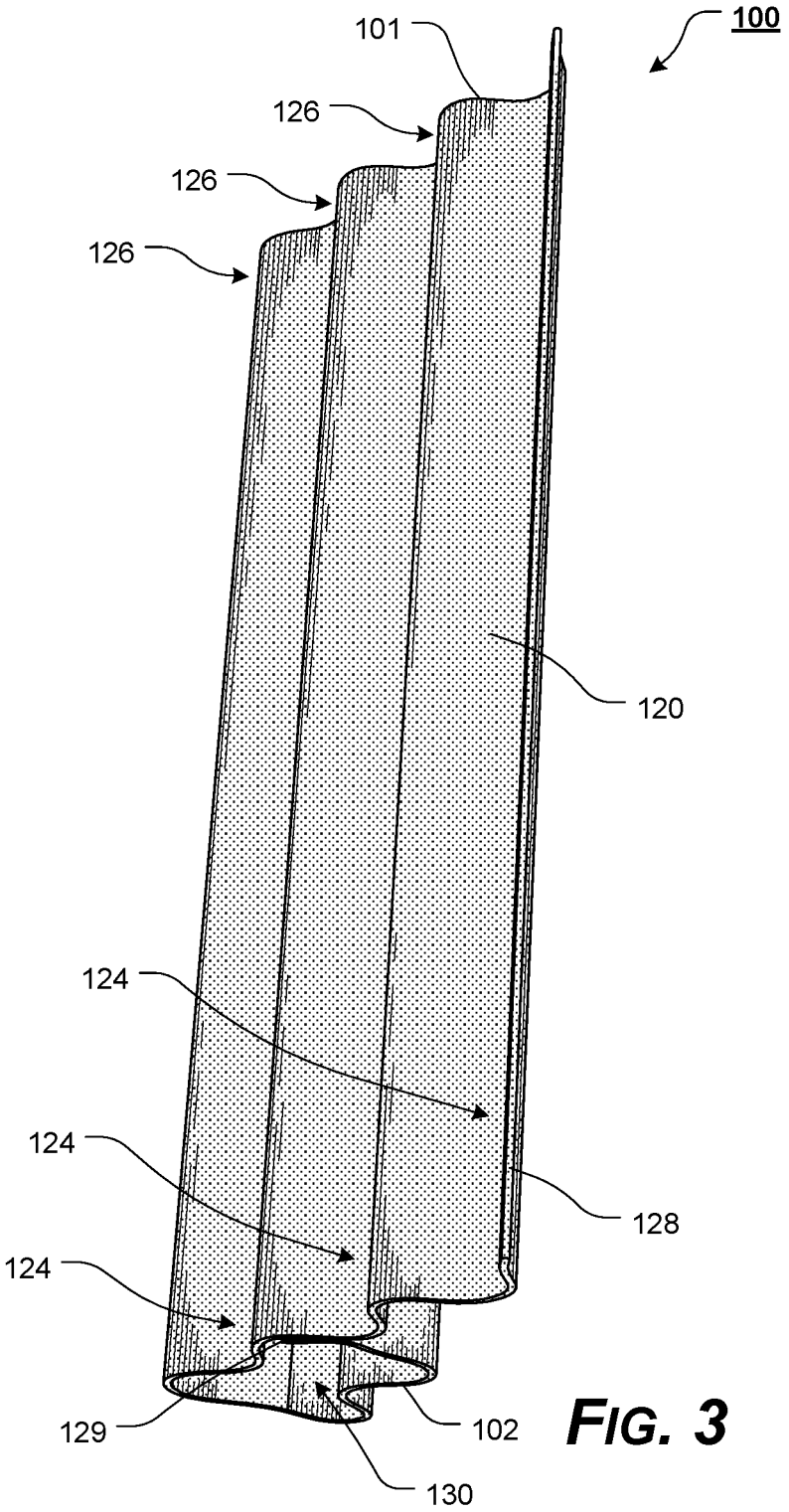
FIG. 3 illustrates a lower perspective view of an exemplary embodiment of a void filling structural packaging element, according to the present disclosure.
Figure 4:
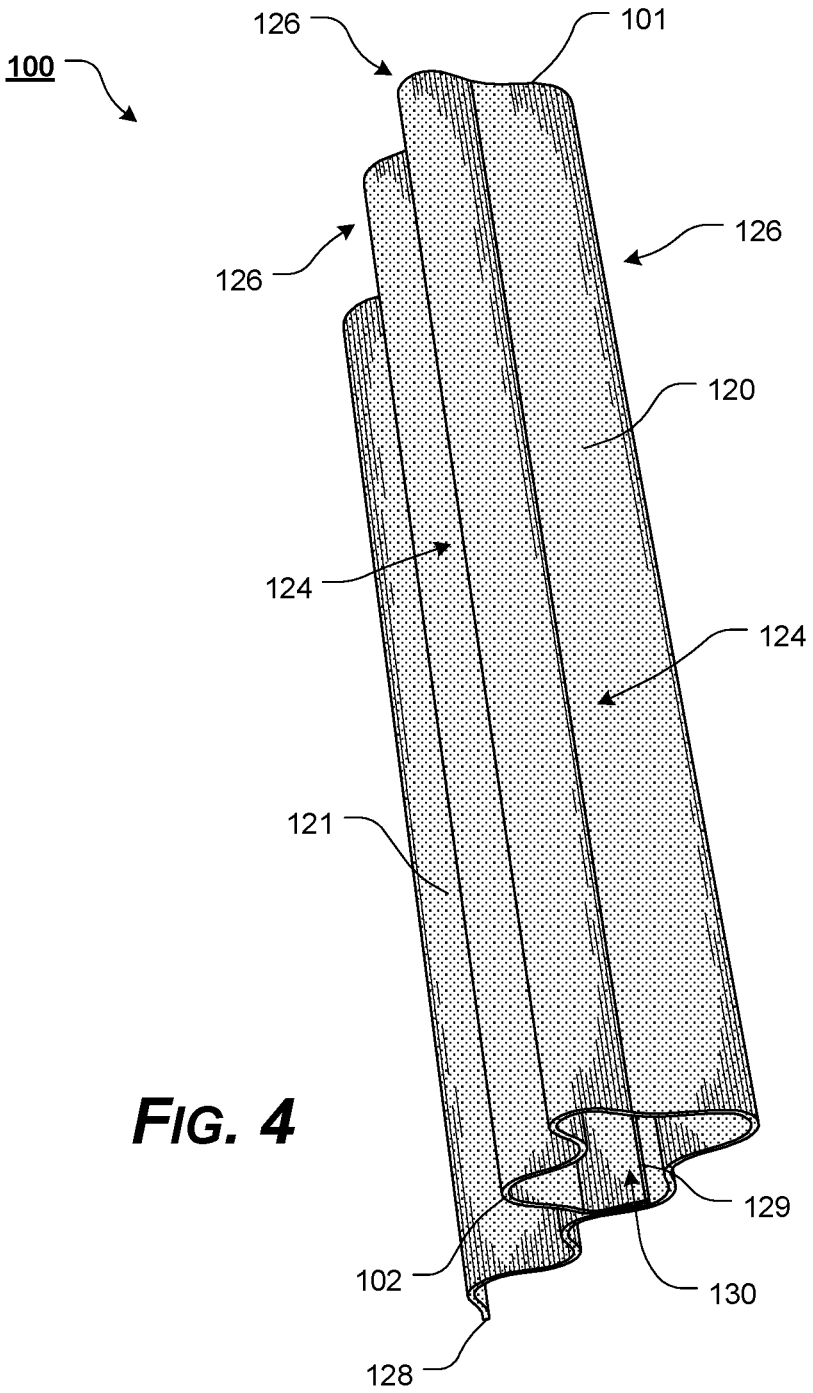
FIG. 4 illustrates a lower perspective view of an exemplary embodiment of a void filling structural packaging element, according to the present disclosure.
Figure 5:
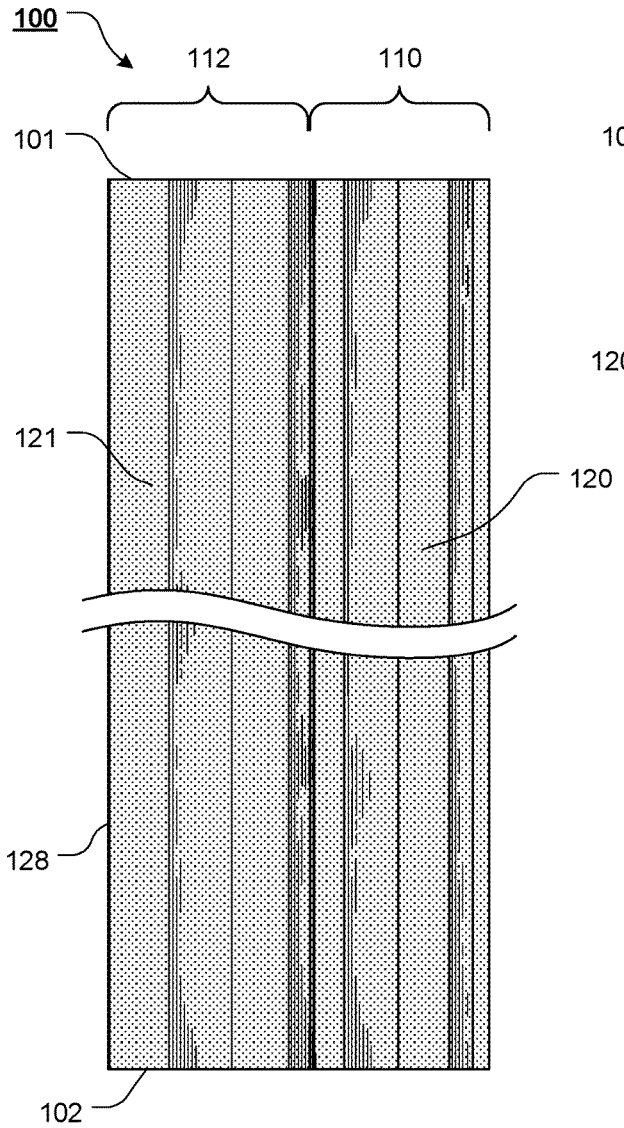
FIG. 5 illustrates a front view of an exemplary embodiment of a void filling structural packaging element, according to the present disclosure.
Figure 6:
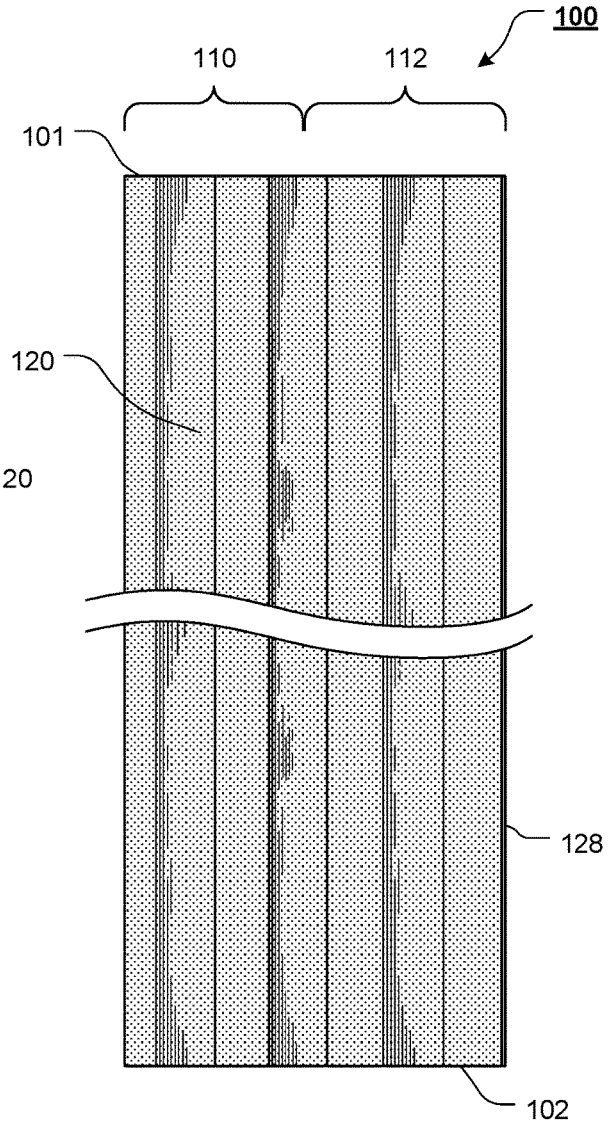
FIG. 6 illustrates a rear view of an exemplary embodiment of a void filling structural packaging element, according to the present disclosure.
Figure 7:
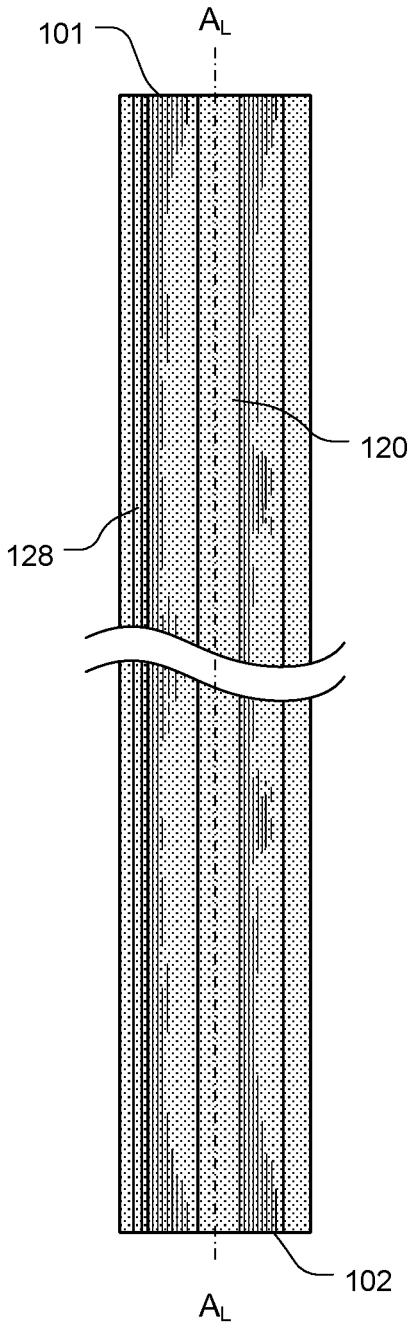
FIG. 7 illustrates a left side view of an exemplary embodiment of a tray or endcap element, according to the present disclosure.
Figure 8:
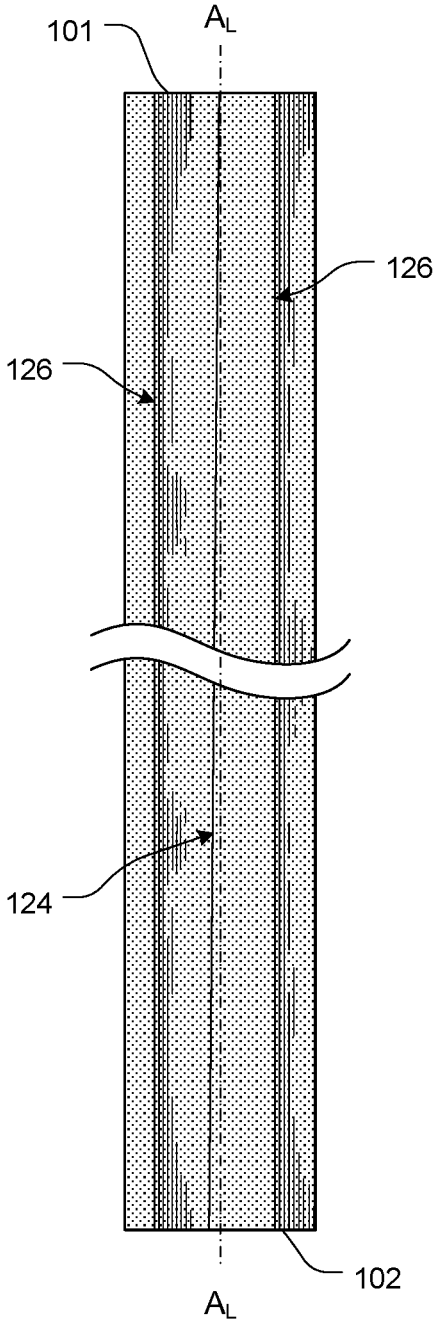
FIG. 8 illustrates a rear side view of an exemplary embodiment of a tray or endcap element, according to the present disclosure.

For simplicity and clarification, the design factors and operating principles of the void filling structural packaging element are explained with reference to various exemplary embodiments of a void filling structural packaging element according to the present disclosure. The basic explanation of the design factors and operating principles of the void filling structural packaging element is applicable for the understanding, design, and operation of the void filling structural packaging element of the present disclosure. It should be appreciated that the void filling structural packaging element can be adapted to applications where a packaging element can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging element" and "void filling structural packaging element" are used for basic explanation and understanding of the operation of the systems, methods, and apparatuses of the present disclosure. Therefore, the terms "packaging element" and "void filling structural packaging element" are not to be construed as limiting the systems, methods, and apparatuses of the present disclosure.

Turning now to the appended drawing figures, FIGS. 1-11 illustrate certain elements and/or aspects of an exemplary embodiment of a void filling structural packaging element 100, while FIGS. 12-24 illustrate certain elements and/or aspects of an exemplary embodiment of a void filling structural packaging element 200, according to the present disclosure. In illustrative, non-limiting embodiment(s) of the present disclosure, as illustrated most clearly in FIGS. 1-11, the void filling structural packaging element 100 comprises an elongate portion of material, forming a sheet 105, which extends, along a longitudinal axis, $A_L$, from a first terminal end 101 to a second terminal end 102. In various exemplary embodiments, the sheet 105 extends continuously, in an uninterrupted manner, from the first terminal end 101 to the second terminal end 102.

In various exemplary embodiments, the material used to form the sheet 105 comprises a single layer of material. Alternatively, the material used to form sheet 105 comprises multiple layers of similar or dissimilar materials joined or adhesively bonded together to form the sheet 105. Thus, it should be appreciated that the sheet 105 may comprise a single layer of material or may be a multi-layer sheet 105 formed of a laminate of a plurality of layers of material attached or coupled by an adhesive or other means.

The sheet 105 may also be formed of a thick sheet, such as, for example, paperboard, chipboard, container board, box board, cardboard, or corrugated fiberboard.

Figure 9:
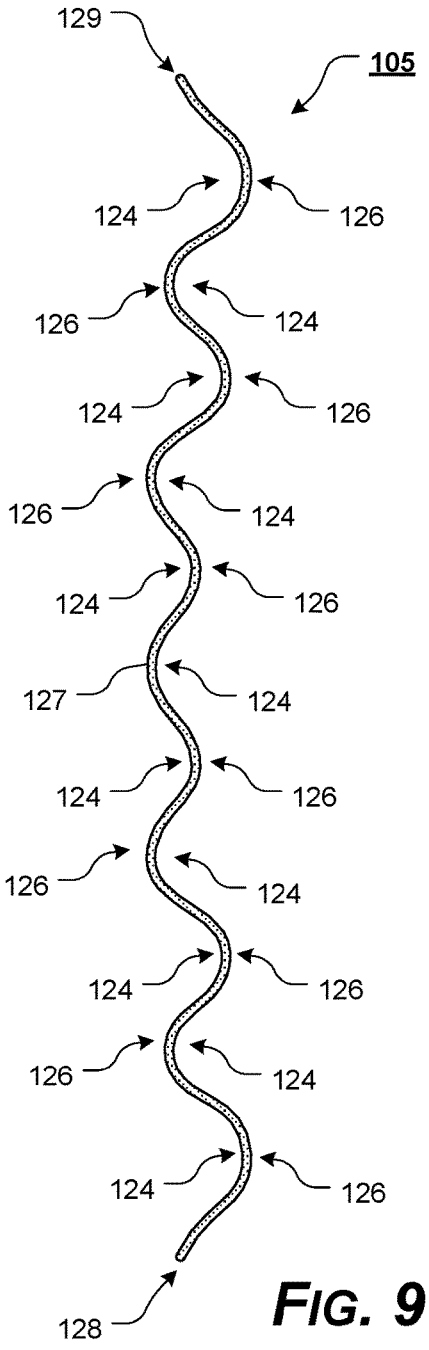
FIG. 9 illustrates a top view of an exemplary embodiment of a sheet used to form a void filling structural packaging element, according to the present disclosure.
Figure 10:
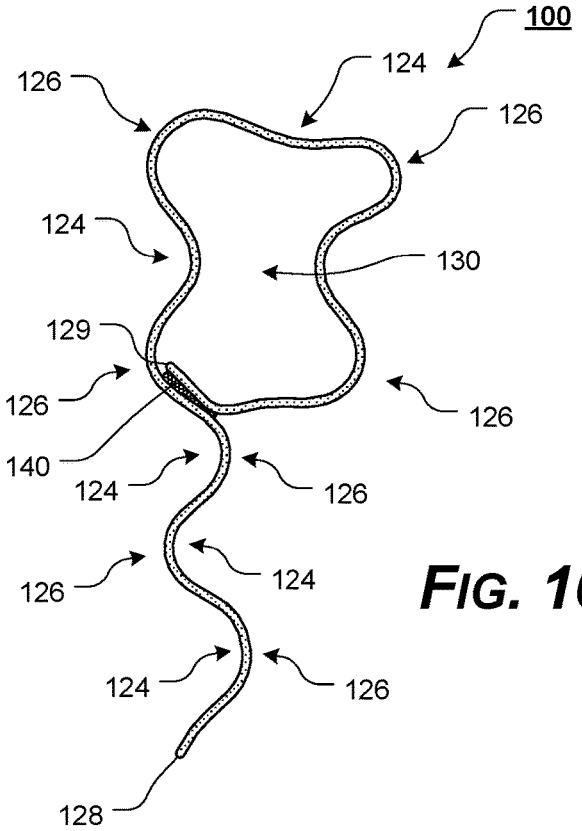
FIG. 10 illustrates a top view of an exemplary embodiment of a void filling structural packaging element, according to the present disclosure.
Figure 11:
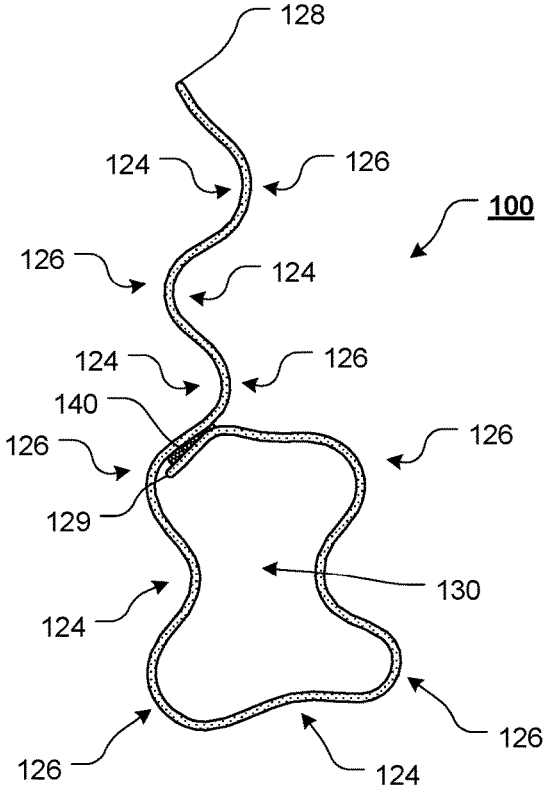
FIG. 11 illustrates a bottom view of an exemplary embodiment of a void filling structural packaging element, according to the present disclosure.
Figure 12:
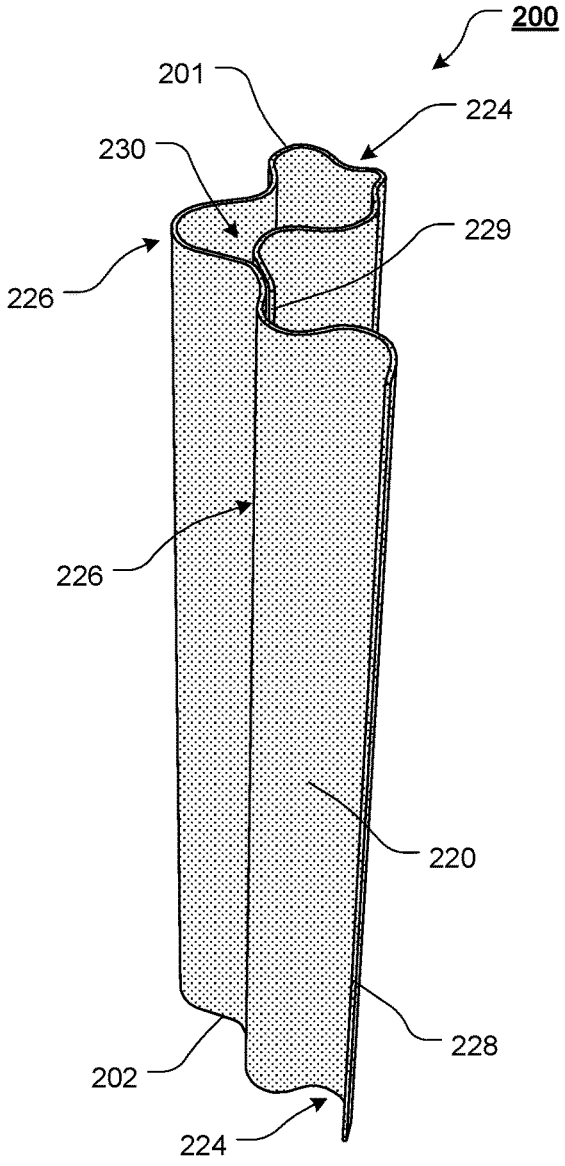
FIG. 12 illustrates an upper perspective view of an exemplary embodiment of a void filling structural packaging element, according to the present disclosure.
Figure 13:
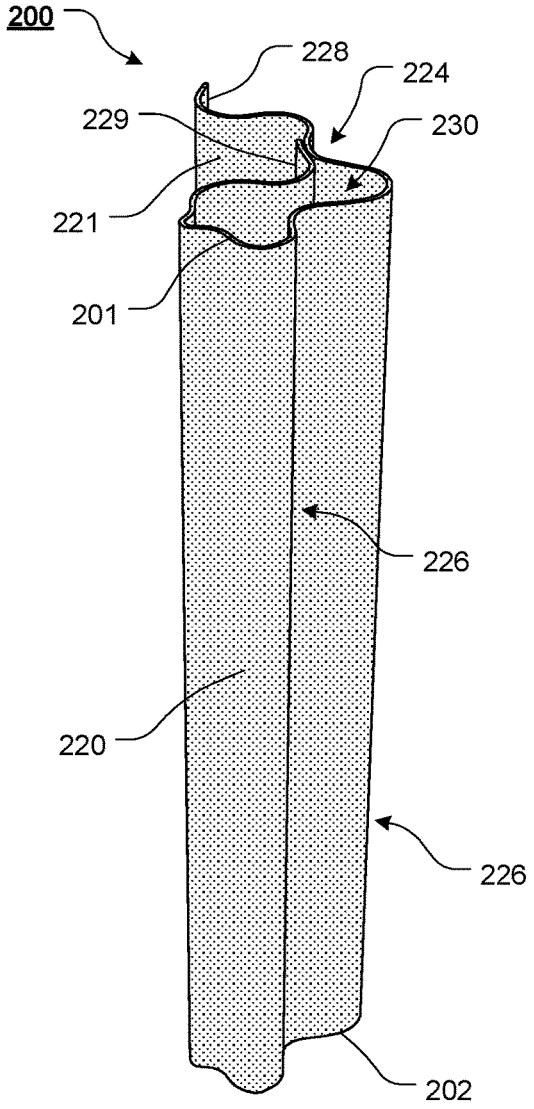
FIG. 13 illustrates an upper perspective view of an exemplary embodiment of a void filling structural packaging element, according to the present disclosure.
Figure 14:
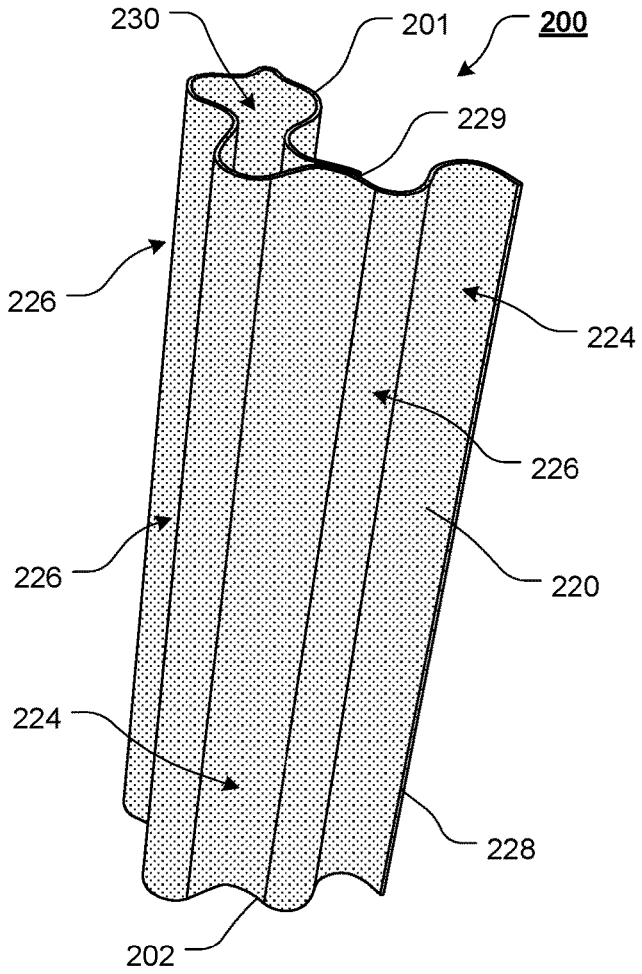
FIG. 14 illustrates an upper perspective view of an exemplary embodiment of a void filling structural packaging element, according to the present disclosure.
Figure 15:
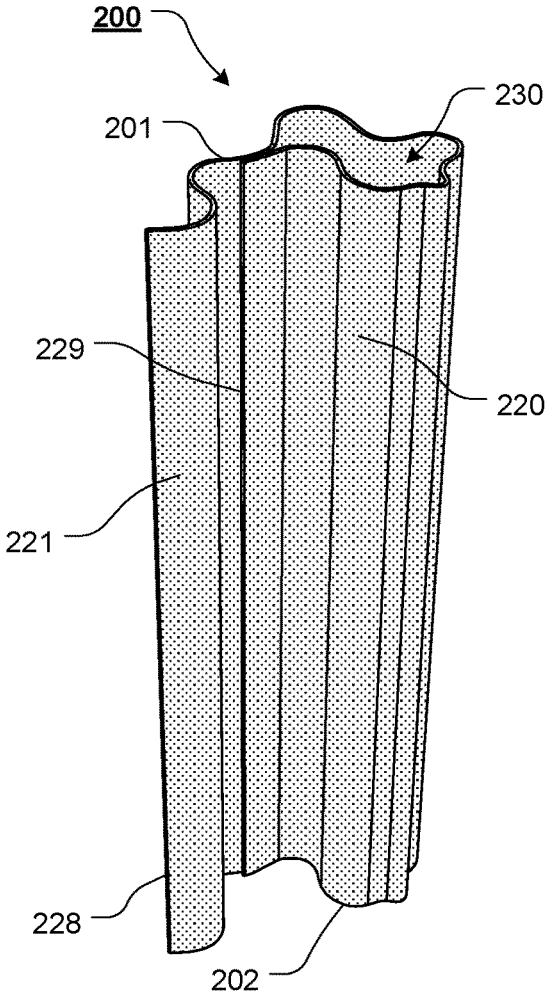
FIG. 15 illustrates an upper perspective view of an exemplary embodiment of a void filling structural packaging element, according to the present disclosure.
Figure 16:
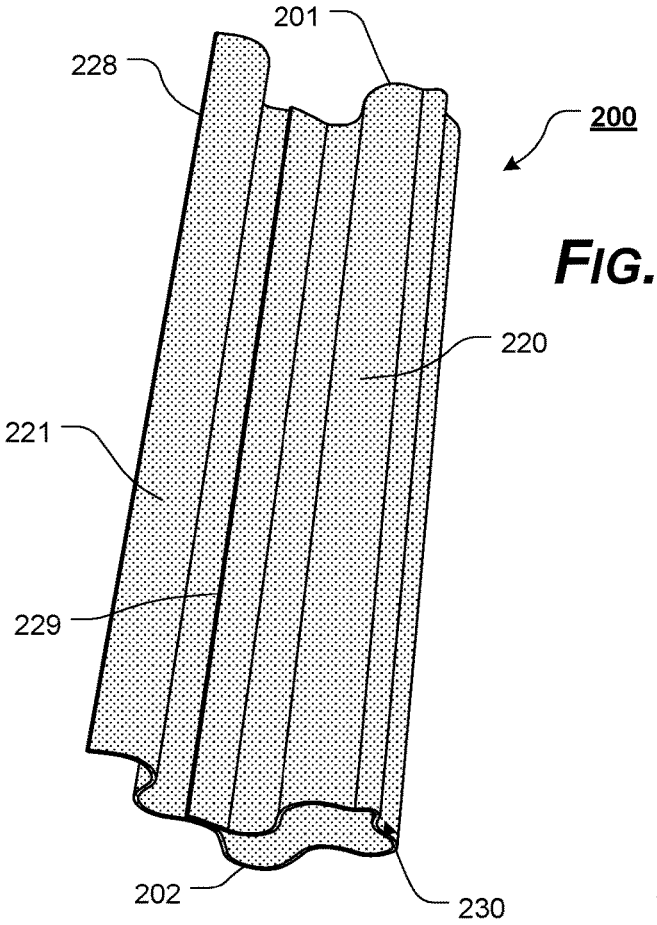
FIG. 16 illustrates a lower perspective view of an exemplary embodiment of a void filling structural packaging element, according to the present disclosure.
Figure 17:
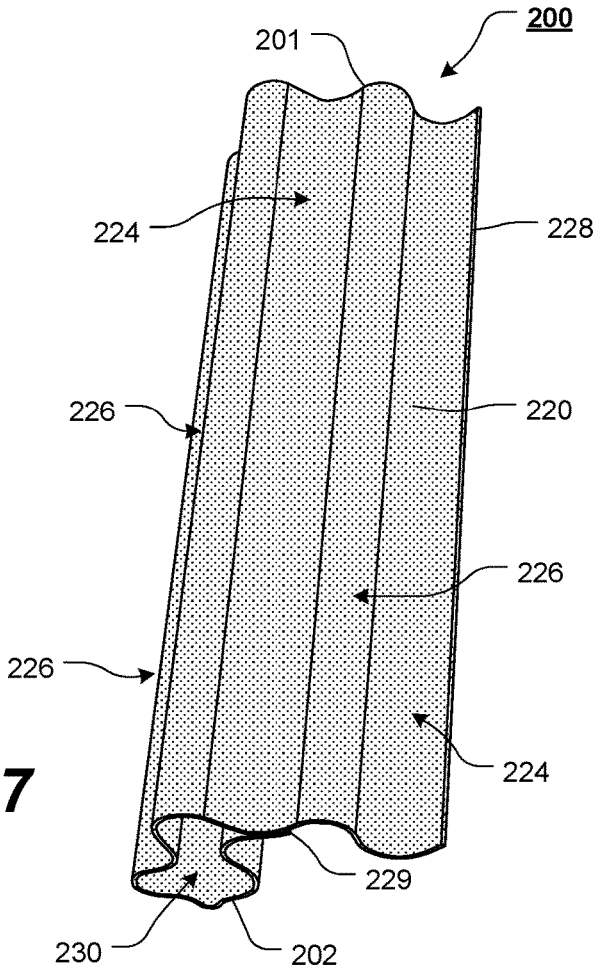
FIG. 17 illustrates a lower perspective view of an exemplary embodiment of a void filling structural packaging element, according to the present disclosure.
Figure 18:
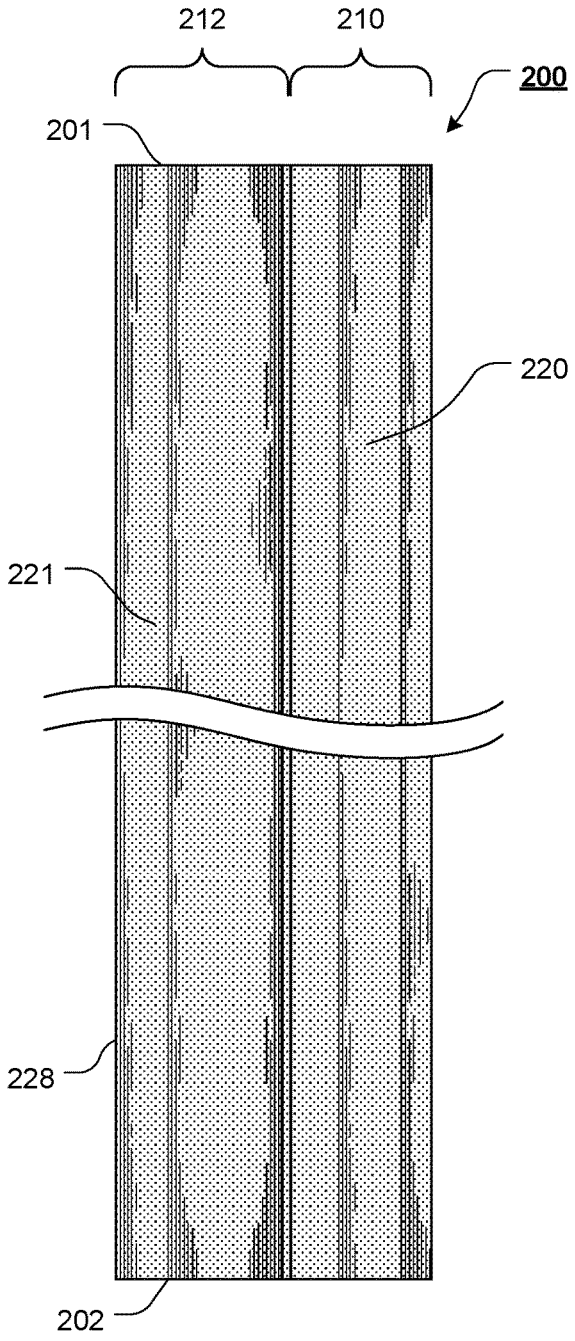
FIG. 18 illustrates a front view of an exemplary embodiment of a void filling structural packaging element, according to the present disclosure.
Figure 19:
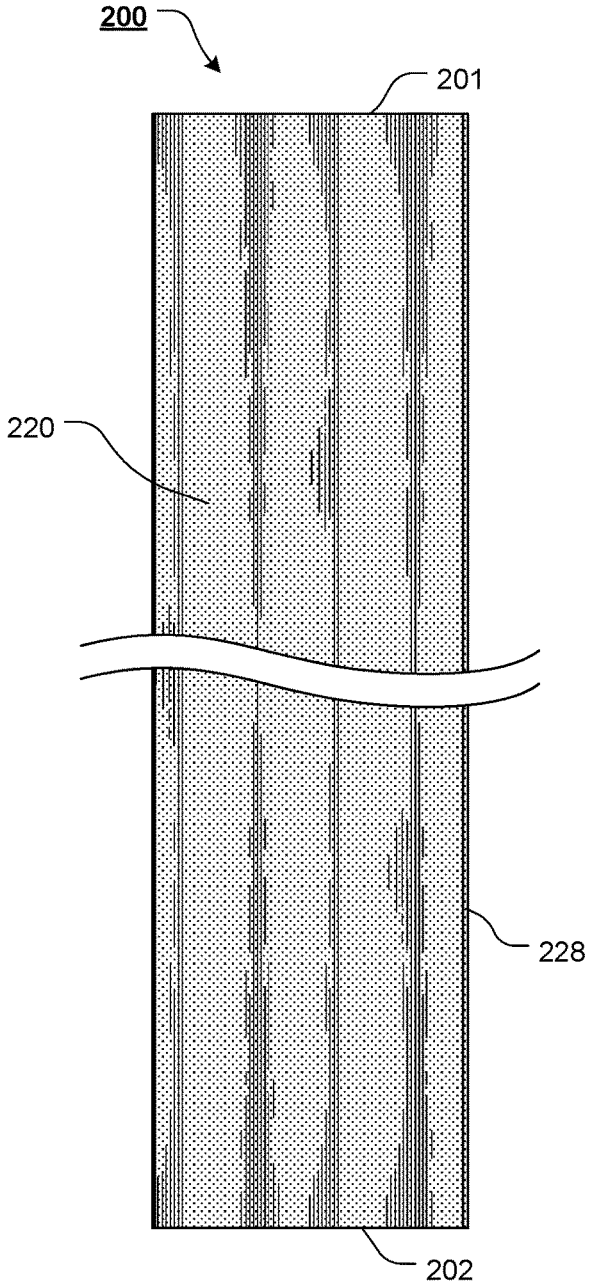
FIG. 19 illustrates a rear view of an exemplary embodiment of a void filling structural packaging element, according to the present disclosure.
Figure 20:
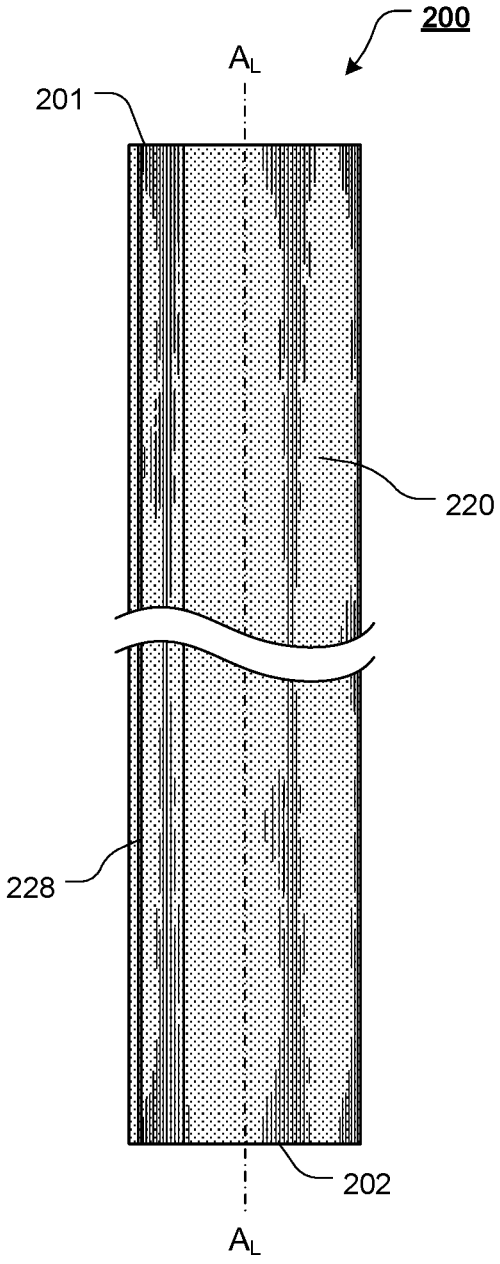
FIG. 20 illustrates a left side view of an exemplary embodiment of a tray or endcap element, according to the present disclosure.
Figure 21:
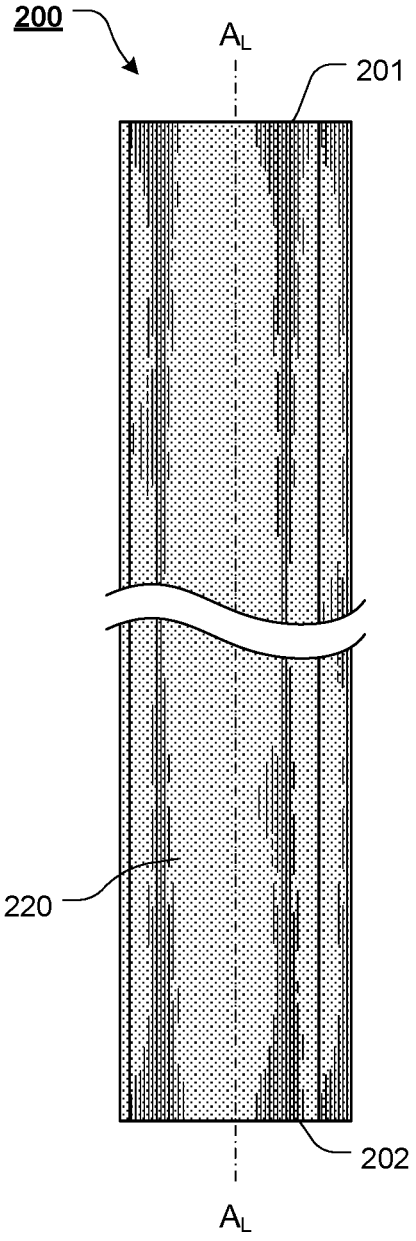
FIG. 21 illustrates a right side view of an exemplary embodiment of a tray or endcap element, according to the present disclosure.
Figure 22:
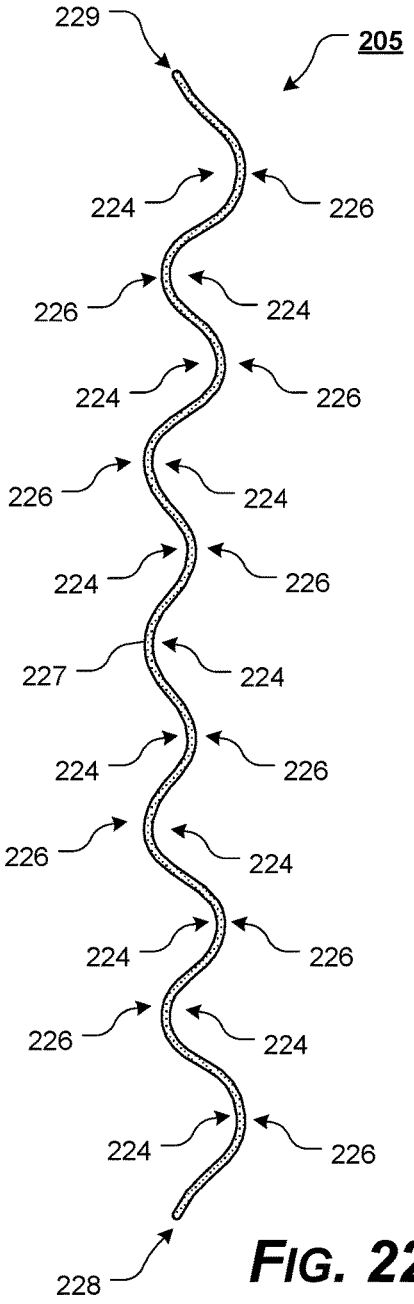
FIG. 22 illustrates a top view of an exemplary embodiment of a sheet used to form a void filling structural packaging element, according to the present disclosure.
Figure 23:
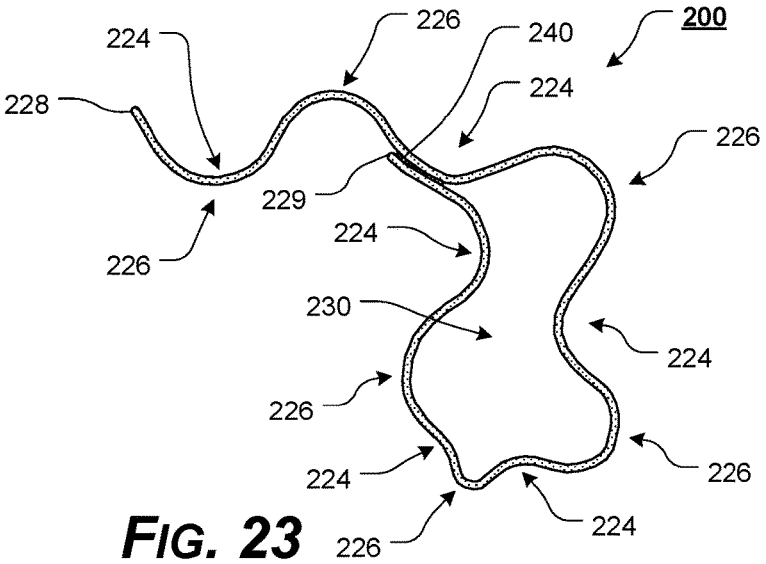
FIG. 23 illustrates a top view of an exemplary embodiment of a void filling structural packaging element, according to the present disclosure.
Figure 24:
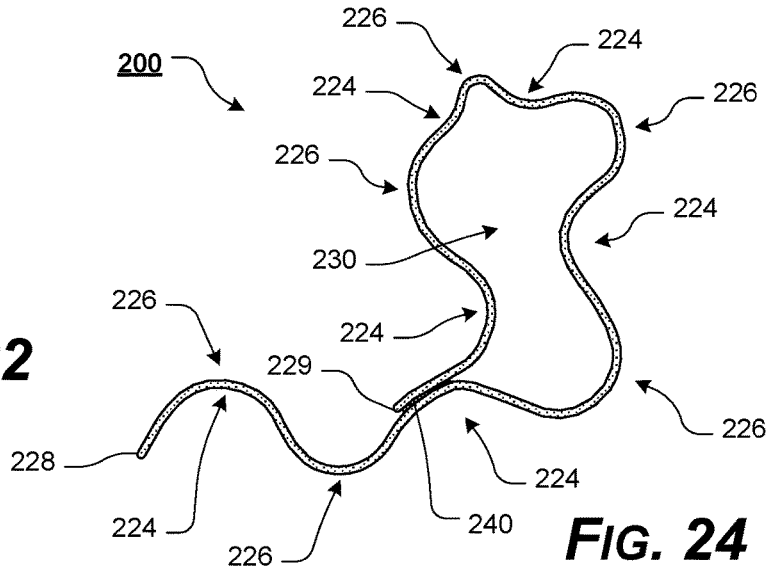
FIG. 24 illustrates a bottom view of an exemplary embodiment of a void filling structural packaging element, according to the present disclosure.

As most easily seen when viewed from the top or bottom, as illustrated, for example, in FIG. 9, the sheet 105 includes one or more alternating ridges 126 and grooves 124, formed along the length of the sheet 105, from the distal end 128 to the proximal end 129. Each of the alternating ridges 126 and grooves 124 of the sheet 105 extends, along or substantially parallel to the longitudinal axis, $A_L$, of the void filling structural packaging element 100. In certain exemplary, nonlimiting embodiments, each of the alternating ridges 126 and grooves 124 are parallel and alternating ridges 126 and grooves 124.

By including the alternating ridges 126 and grooves 124, the sheet 105 is curvilinear along its length, from the distal end 128 to the proximal end 129. The alternating ridges 126 and grooves 124 may be formed such that the sheet 105 comprises a sinusoidal succession of waves or curves, along the length, from the distal end 128 to the proximal end 129.

An outer wall 120 forms an exterior surface of the sheet 105, while an inner wall 121 forms and interior surface of the sheet 105. As used herein, the terms "outer", "exterior", "inner", and "interior" are used for reference only and are not to be viewed as limiting the present disclosure. In certain exemplary, non-limiting embodiments, the outer wall 120 of the sheet 105 is substantially coextensive with the inner wall 121 of the sheet 105.

Because of the inclusion of the alternating ridges 126 and grooves 124, the sheet 105, and ultimately the body portion 110, the packaging element leg portion 112, and the void filling structural packaging element 100, is better able to resist end to end compression, along or parallel to the longitudinal axis, $A_L$, of the void filling structural packaging element 100. Additionally, the inclusion of the alternating ridges 126 and grooves 124 helps each of the body portion 110 and packaging element leg portion 112 to better resist crushing (or resist a determined amount of crushing), when forces are applied to the outer wall 120 and/or the inner wall 121.

The alternating ridges 126 and grooves 124 allow for a degree of inward and/or outward flexion and resilient recovery toward the original shape of the various portions of the sheet 105.

In various exemplary embodiments, the sheet 105 is substantially rigid and is formed of cardboard. Alternate materials of construction of the sheet 105 may include one or more of the following: thick paper (of various types), pasteboard, paperboard, container board, corrugated fiberboard, box board, or chipboard. In still other exemplary embodiments, alternate materials of construction of the sheet 105 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the sheet 105 is a design choice based on the desired appearance and functionality of the sheet 105.

The body portion 110 is formed by curving or bending a portion of the sheet 105 and attaching an end portion of the sheet 105, such as, for example, an area proximate the proximal end 129, to a portion of a side wall, such as, for example, a portion of the inner wall 121, of the sheet 105. The sheet 105 may include a single fold or multiple folds to form the body portion 110.

In certain exemplary, nonlimiting embodiments, a score mark 127 or a complete or partial perforation is formed along the longitudinal axis, $A_L$, of the sheet 105. The score mark 127 provides a line or area along which the sheet 105 may be bent. By bending the sheet 105 along the score mark 127, a portion of the sheet 105 can be more easily folded or wrapped to form the body portion 110. In certain embodiments, score marks 127 or complete or partial perforations may be formed at spaced apart locations along the longitudinal axis, $A_L$, of the sheet 105 to provide lines or areas along which the sheet 105 may be bent to more easily form the body portion 110 of the void filling structural packaging element 100.

An area of the outer wall 120, proximate the proximal end 129 may be attached or coupled to a portion of the inner wall 121, via an adhesive 140. It should be appreciated that in an alternative embodiment, an area of the inner wall 121, proximate the proximal end 129 may be attached or coupled to a portion of the inner wall 121. If attached or coupled by an adhesive 140, the adhesive 140 may comprise, for example, a hot melt, reactive hot melt, thermosetting, pressure sensitive, contact, or other adhesive. Alternatively, an area proximate the proximal end 129 may be attached or coupled to a portion of the inner wall 121, via a mechanical or other means, such as, for example, stapling.

In various exemplary embodiments, the body portion 110 forms a substantially square or rectangular body portion 110, having four wall segments, each including a corrugated wall portion having one or more alternating ridges 126 and/or grooves 124. It should be appreciated that the overall size and shape of the body portion 110 is a design choice, based upon a desired void to be filled between a packaged element and one or more interior sidewalls of the desired element packaging.

A deformable hollow 130 is formed or defined within the body portion 110. For example, the deformable hollow 130 may be formed by a portion of the inner wall 121 within the body portion 110.

A packaging element leg portion 112 is formed of the portion of the sheet 105 that extends from the body portion 110. Thus, in various exemplary, nonlimiting embodiments, the void filling structural packaging element 100 forms a is substantially "P", "b", or "d" shape, when viewed from a top or bottom.

The void filling structural packaging element 100 may be constructed having an any desired overall size or shape. It should also be understood that the overall size and shape of the void filling structural packaging element 100, and the various portions thereof, is a design choice based upon the desired functionality, compatibility with desired articles or products and/or appearance of the void filling structural packaging element 100.

Thus, it should be appreciated that the overall length, width, and/or height of the body portion 110 and the packaging element leg portion 112 is a design choice, based upon the desired degree of packaging or cushioning provided by the void filling structural packaging element 100 and/or the size and shape of the article or product with which the void filling structural packaging element 100 is to be utilized.

In certain exemplary, nonlimiting embodiments, at least a portion of the outer wall 120 and/or the inner wall 121 may be textured or may include an adhesive portion to provide a surface or area having a desired degree of friction or adhesive bonding relative to a product or product packaging. Thus, at least a portion of the void filling structural packaging element 100 may be formed so as to resist movement of the void filling structural packaging element 100 relative to a surface.

During use, the void filling structural packaging element 100 is positioned between an article or product and an inner surface of a package within which the article or product is to be at least partially positioned. Typically, the body portion 110 is positioned within a void formed between the article or product and an inner surface of the product packaging. The packaging element leg portion 112 is positioned within a comparatively smaller void between the article or product and an inner surface of the product packaging. The apexes of alternating ridges 126 make contact portions of the surface of the interior of the product packaging and the article or product to maintain the article or product in a desired position relative to the product packaging and provide package cushioning or support to the article or product during shipping, transport, or storage.

In certain exemplary embodiments, adhesives may be utilized to further secure the void filling structural packaging element 100 in a desired position relative to either the article or product or to the product packaging.

During shipping, transport, or storage of the article or product, the void filling structural packaging element 100 helps to resist movement of the article or product within the product packaging. Additionally, if the product packaging is bumped or jarred, causing the article or product to shift within the product packaging, the alternating ridges 126 and grooves 124 allow for a degree of inward and/or outward flexion and resilient recovery toward the original shape of the packaging element leg portion 112. Additionally, the deformable hollow 130 may partially or completely deform to absorb impact between the article or product in the product packaging. Similarly, if an item impacts the exterior of the product packaging, the deformable hollow 130 and/or the packaging element leg portion 112 may partially or completely deform to absorb impact between the product packaging and the article or product.

FIGS. 12-24 illustrate certain elements and/or aspects of an exemplary embodiment of a void filling structural packaging element 200, according to the present disclosure. As illustrated in FIGS. 12-24, the void filling structural packaging element 200 comprises at least some of a sheet 205 extending from a first terminal end 201 to a second terminal end 202, between a distal end 228 and a proximal end 229, having an outer wall 220 and an inner wall 221, a plurality of grooves 224 and ridges 226, an optional score mark 227, an adhesive 240, a body portion 210 defining a deformable hollow 230 and a packaging element leg portion 212.

It should be understood that the these components and/or elements correspond to and operate similarly to the sheet 105, the first terminal end 101, the second terminal end 102, the distal end 128, the proximal end 129, the outer wall 120, the inner wall 121, the grooves 124, the ridges 126, the optional score mark 127, the adhesive 140, the body portion 110, the deformable hollow 130, and the packaging element leg portion 112, as described above with reference to the void filling structural packaging element 100.

However, as illustrated in FIGS. 12-24, an area of the inner wall 221, proximate the proximal end 229 is optionally attached or coupled to a portion of the inner wall 221, via an adhesive 240. In this embodiment, the body portion 210, and the deformable hollow 230, have a substantially free-form or rectangular shape.

Thus, it should be appreciated that a point or area of the outer wall 220 or inner wall 221 of the sheet 205 (or the outer wall 120 or inner wall 121 of the sheet 105) may be attached or coupled to a point or area of the inner wall 221 (or inner wall 121) at any desired point or area of the inner wall 221 (or inner wall 121), between the distal end 228 and the proximal end 229 (or the distal end 128 and the proximal end 129).

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A void filling structural packaging element, comprising:

a sheet formed of an elongate portion of material, wherein said sheet extends, along a longitudinal axis, from a first terminal end to a second terminal end, and wherein said sheet includes one or more alternating ridges and grooves, formed along a length of said sheet, from a proximal end to a terminating distal end;

a body portion formed by an end portion of said sheet attached or coupled to a portion of a surface of said sheet, and wherein a deformable hollow is defined within said body portion; and a packaging element leg portion formed of a portion of said sheet that extends from said body portion to said terminating distal end.

2. The void filling structural packaging element of claim 1, wherein said sheet extends continuously, from said first terminal end to said second terminal end.

3. The void filling structural packaging element of claim 1, wherein said sheet comprises a single layer of material.

4. The void filling structural packaging element of claim 1, wherein said sheet comprises paperboard, chipboard, container board, box board, cardboard, or corrugated fiberboard.

5. The void filling structural packaging element of claim 1, wherein each of said alternating ridges and grooves extends substantially parallel to said longitudinal axis of said sheet.

6. The void filling structural packaging element of claim 1, wherein said sheet is curvilinear along said length of said sheet, from said proximal end to said terminating distal end.

7. The void filling structural packaging element of claim 1, wherein said alternating ridges and grooves form a sinusoidal succession of waves or curves.

8. The void filling structural packaging element of claim 1, wherein said body portion is formed by a portion of an inner surface of an end portion of said sheet, proximate said proximal end, attached or coupled to a portion of said inner surface of said sheet.

9. The void filling structural packaging element of claim 1, wherein said body portion is formed by a portion of an outer surface of an end portion of said sheet, proximate said proximal end, attached or coupled to a portion of said inner surface of said sheet.

10. The void filling structural packaging element of claim 1, wherein said body portion forms a substantially square, rectangular, or free-form shape.

11. The void filling structural packaging element of claim 1, further comprising a score mark or perforation formed substantially parallel to said longitudinal axis of said sheet.

12. A void filling structural packaging element, comprising:

a sheet, wherein said sheet extends, along a longitudinal axis, from a first terminal end to a second terminal end, and wherein said sheet is curvilinear along a length of said sheet, from a proximal end to a terminating distal end;

a body portion formed by an end portion of said sheet attached or coupled to a portion of a surface of said sheet, and wherein a deformable hollow is defined within said body portion; and a packaging element leg portion formed of a portion of said sheet that extends from said body portion to said terminating distal end.

13. The void filling structural packaging element of claim 12, wherein said sheet extends continuously, from said first terminal end to said second terminal end.

14. The void filling structural packaging element of claim 12, wherein said sheet comprises a single layer of material.

15. The void filling structural packaging element of claim 12, wherein said sheet comprises a multi-layer sheet.

16. The void filling structural packaging element of claim 12, wherein said body portion is formed by a portion of an inner surface of an end portion of said sheet, proximate said proximal end, attached or coupled to a portion of said inner surface of said sheet.

17. The void filling structural packaging element of claim 12, wherein said body portion is formed by a portion of an outer surface of an end portion of said sheet, proximate said proximal end, attached or coupled to a portion of said inner surface of said sheet.

18. The void filling structural packaging element of claim 12, further comprising a score mark or perforation formed substantially parallel to said longitudinal axis of said sheet.

19. A void filling structural packaging element, comprising:

a sheet, wherein said sheet extends, along a longitudinal axis, from a first terminal end to a second terminal end, wherein said sheet is curvilinear along a length of said sheet, from a proximal end to a terminating distal end, and wherein said sheet includes a body portion and a packaging element leg portion;

wherein said body portion is formed by an end portion of said sheet attached or coupled to a portion of a surface of said sheet, and wherein a deformable hollow is defined within said body portion; and wherein said packaging element leg portion is formed of a portion of said sheet that extends from said body portion to said terminating distal end.

20. The void filling structural packaging element of claim 19, wherein said body portion is formed by a portion of an inner surface or an outer surface of said sheet, attached or coupled to a portion of said inner surface of said sheet.

* * * * *